US008365442B2

(12) United States Patent
Baker et al.

(10) Patent No.: US 8,365,442 B2
(45) Date of Patent: Feb. 5, 2013

(54) CLEAT ASSEMBLY

(75) Inventors: Brian D. Baker, Portland, OR (US); Alexandre Baudouin, Portland, OR (US); Thomas G. Bell, Portland, OR (US); Daniel W. Peter, Portland, OR (US)

(73) Assignee: Nike, Inc., Beaverton, OR (US)

( * ) Notice: Subject to any disclaimer, the term of this patent is extended or adjusted under 35 U.S.C. 154(b) by 437 days.

(21) Appl. No.: 12/716,679

(22) Filed: Mar. 3, 2010

(65) Prior Publication Data

US 2011/0214314 A1 Sep. 8, 2011

(51) Int. Cl.
*A43B 5/00* (2006.01)

(52) U.S. Cl. ..... 36/59 R; 36/67 R; 36/134

(58) Field of Classification Search ..... 36/67 R, 36/67 D, 59 R, 134, 114
See application file for complete search history.

(56) References Cited

U.S. PATENT DOCUMENTS

| | | | | | |
|---|---|---|---|---|---|
| 402,138 | A | * | 4/1889 | Burnham | 36/59 R |
| 2,061,963 | A | * | 11/1936 | Gabriele | 36/59 R |
| 2,095,095 | A | * | 10/1937 | Howard | 36/59 R |
| 2,258,805 | A | * | 10/1941 | Philips | 36/59 R |
| 2,268,057 | A | * | 12/1941 | Newman | 36/126 |
| 3,040,450 | A | | 6/1962 | Phillips | |
| 3,063,171 | A | | 11/1962 | Hollander | |
| 3,656,245 | A | | 4/1972 | Wilson | |
| 4,233,759 | A | | 11/1980 | Bente et al. | |
| 4,586,274 | A | | 5/1986 | Blair | |
| 5,513,451 | A | * | 5/1996 | Kataoka et al. | 36/129 |
| 5,628,129 | A | | 5/1997 | Kilgore et al. | |
| 5,836,091 | A | | 11/1998 | Cook | |
| 5,940,993 | A | | 8/1999 | Ronci | |
| 6,018,893 | A | | 2/2000 | Workman | |
| 7,073,281 | B2 | * | 7/2006 | Terashima | 36/134 |
| 7,086,183 | B2 | | 8/2006 | Wood et al. | |
| 7,134,226 | B2 | | 11/2006 | Robinson, Jr. et al. | |
| D553,336 | S | | 10/2007 | McMullin | |
| 7,386,948 | B2 | | 6/2008 | Sink | |
| 7,428,790 | B2 | | 9/2008 | Pellerin | |
| 8,151,485 | B2 | * | 4/2012 | Hurd et al. | 36/27 |
| 2002/0078603 | A1 | * | 6/2002 | Schmitt, Jr. | 36/134 |
| 2005/0278981 | A1 | * | 12/2005 | McMullin | 36/134 |
| 2007/0062070 | A1 | | 3/2007 | Kuhtz et al. | |
| 2007/0101618 | A1 | * | 5/2007 | Peake | 36/134 |
| 2007/0277399 | A1 | | 12/2007 | Dow et al. | |
| 2008/0072459 | A1 | * | 3/2008 | Robinson et al. | 36/134 |
| 2008/0072460 | A1 | | 3/2008 | Robinson et al. | |
| 2008/0098624 | A1 | | 5/2008 | Goldman | |
| 2008/0196276 | A1 | * | 8/2008 | McMullin | 36/127 |
| 2008/0222924 | A1 | * | 9/2008 | Carruthers | 36/127 |
| 2009/0307933 | A1 | * | 12/2009 | Leach | 36/134 |
| 2010/0186261 | A1 | * | 7/2010 | Baker et al. | 36/134 |
| 2010/0251578 | A1 | | 10/2010 | Auger et al. | |

OTHER PUBLICATIONS

Invitation to Pay Additional Fees and, Where Applicable, Protest Fee mailed Feb. 17, 2012 in International Application No. PCT/US2011/026822.

International Search Report and Written Opinion mailed Apr. 24, 2012 in International Application No. PCT/US2011/026822.

* cited by examiner

*Primary Examiner* — Marie Patterson
(74) *Attorney, Agent, or Firm* — Plumsea Law Group, LLC

(57) ABSTRACT

A cleat for use with an article of footwear is disclosed. The cleat includes a projection, a curved portion with a beveled edge, and a lever arm. A centipede cleat assembly can be formed from a plurality of cleats. The centipede cleat assembly attaches to an outsole of an article of footwear.

23 Claims, 10 Drawing Sheets

CLEAT ASSEMBLY

BACKGROUND

The present invention relates generally to cleats for use on an article of footwear, and in particular to a cleat with an arm member.

Conventional articles of footwear may include cleats disposed on an outsole of the article of footwear. Typically, cleats are used on articles of footwear associated with various sports, including, but not limited to: golf, baseball, football, soccer, and other sports and activities where traction with a playing surface may be aided by an article of footwear provided with a cleat.

Conventional cleats are available in many different designs and configurations. In some cases, a cleat design and/or configuration may be optimized according to the playing surface with which the article of footwear with the cleat is to be used. Generally, a cleat is designed to provide traction with the playing surface, while allowing the wearer to maintain a level of stability and mobility.

Traction with a playing surface is generally provided by the grip a cleat has with the specific playing surface. In the case of natural surfaces, such as grass or dirt, a cleat may partially penetrate the surface to provide the traction-producing grip. Depending on the amount of penetration, more or less grip may be produced. In the case of synthetic surfaces, such as artificial turf, a cleat may provide traction through friction with the fibers of the synthetic surface. With both natural and synthetic playing surfaces, the amount of traction provided by a cleat is typically balanced with the need to allow the wearer to move and to provide stability.

The grip of a cleat with a playing surface also provides resistance for a wearer to propel himself or herself in a desired direction. The cleats of an article of footwear exert a force against the playing surface that provides the resistance to allow the wearer to move in the desired direction without slipping. Accordingly, a wearer may move in a lateral and/or longitudinal direction by pushing against the force of the cleat's grip with the playing surface.

The design of a cleat and/or the configuration of multiple cleats on an outsole of an article of footwear can also provide a level of stability to a foot of the wearer relative to the playing surface.

Accordingly, there is a need in the art for a cleat design that provides traction, while still allowing the wearer to move in a desired direction and while also providing a level of stability.

SUMMARY

In one aspect, the invention provides a cleat for an article of footwear comprising: a first member terminating in a first end and a second end, the first end further including a first projection and a first curved portion, and wherein the first curved portion includes a first beveled edge.

In another aspect, the invention provides a cleat for an article of footwear comprising: a first lever arm, a first ground-engaging portion disposed at a first end of the first lever arm, a second end of the first lever arm attached to a sole of an article of footwear, and wherein the second end is attached to the sole to allow individual articulation of the first lever arm.

In another aspect, the invention provides an article of footwear, comprising: an upper, a sole assembly attached to the upper, a plurality of cleats attached to the sole assembly, wherein each of the plurality of cleats comprises: a lever arm, a ground-engaging portion disposed at a first end of the lever arm, the ground-engaging portion further including a projection and a curved portion, and wherein the curved portion includes a beveled edge.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
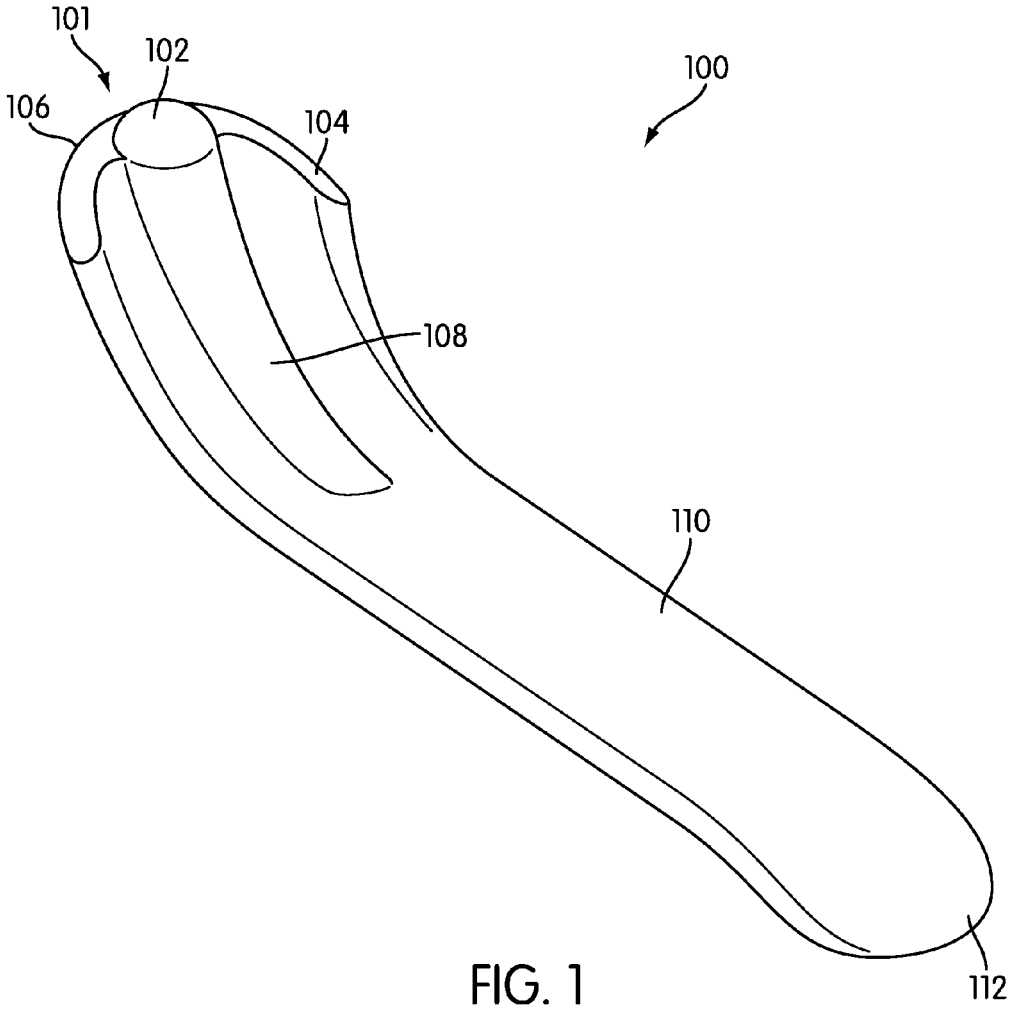
FIG. 1 is an isometric view of an embodiment of a cleat with an arm member.
Figure 2:
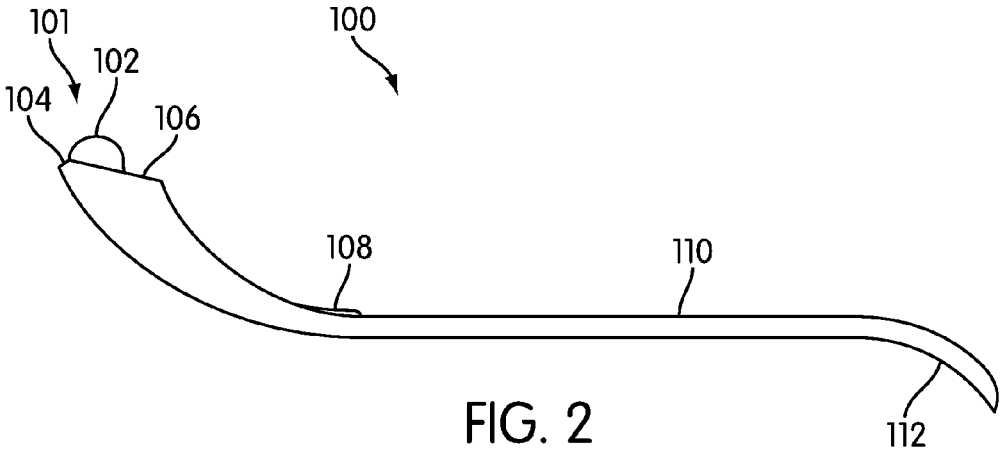
FIG. 2 is a side view of an embodiment of a cleat with an arm member.
Figure 3:
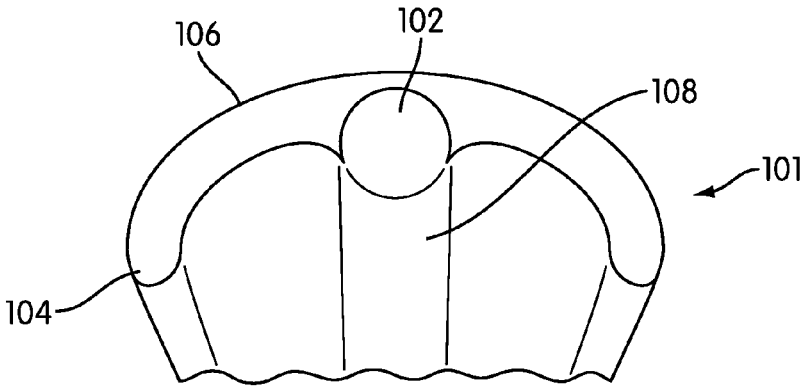
FIG. 3 is a close up view of an embodiment of a cleat.

FIGS. 1 through 3 illustrate an exemplary embodiment of a cleat 100 for use with an article of footwear. Cleat 100 can be used with any type of footwear. In some embodiments, cleat 100 may used with one or more articles of footwear, including a pair of footwear. Generally, articles of footwear used with cleat 100 can be any type of footwear. For clarity, the following detailed description discusses articles of footwear in the form of shoes associated with various sports, including, but not limited to: golf, baseball, football, soccer, rugby and other sports and activities where traction with a playing surface may be aided by an article of footwear provided with a cleat. However, it should be noted that in other embodiments any other type of footwear could be used including, but not limited to: hiking boots, basketball shoes, sneakers, as well as other kinds of shoes. Articles of footwear used with cleat 100 may also take the form of any non-athletic shoe, including, but not limited to: dress shoes, loafers, sandals, and boots. An individual skilled in the relevant art will appreciate, therefore, that the concepts disclosed herein apply to a wide variety of footwear styles, in addition to the specific style discussed in the following material and depicted in the accompanying figures.

For consistency and convenience, directional adjectives are employed throughout this detailed description corresponding to the illustrated embodiments. The term "longitudinal" as used throughout this detailed description and in the claims refers to a direction extending a length or major axis of an article. In some cases, the longitudinal direction may extend from a forefoot portion to a heel portion of the article. Also, the term "lateral" as used throughout this detailed description and in the claims refers to a direction extending a width or minor axis of an article. In other words, the lateral direction may extend between a medial side and a lateral side of an article. Furthermore, the term "vertical" as used throughout this detailed description and in the claims refers to a direction generally perpendicular to a lateral and longitudinal direction. For example, in cases where an article is planted flat on a ground surface, the vertical direction may extend from the ground surface upward. In addition, the term "proximal" refers to a portion of a footwear component that is closer to a portion of a foot when an article of footwear is worn. Likewise, the term "distal" refers to a portion of a footwear component that is further from a portion of a foot when an article of footwear is worn. It will be understood that each of these directional adjectives may be applied to individual components of an article, such as an upper and/or a sole structure.

Referring to FIGS. 1 and 2, in some exemplary embodiments, a cleat 100 may include a ground-engaging portion with a projection 102 disposed at a first end 101 of a member 110. In this embodiment, projection 102 is a dome shape extending outward from first end 101 of member 110. In different embodiments, projection 102 may be different sizes, including, but not limited to: extending outward various distances from first end 101 of member 110, having various widths (or radii in the case of round projections), as well as extending in various combinations of other lateral, longitudinal, and vertical directions. In some cases, projection 102 may be sized and dimensioned so as to provide enhanced performance for a particular type of playing surface. In different embodiments, projection 102 may be various shapes including, but not limited to: oval, round, semi-spherical, elliptical, square, rectangular, triangular, star-shaped, and other geometric and regular or irregular shapes.

Cleat 100 also may include an edge 104 on a ground-engaging portion of first end 101. In an exemplary embodiment, edge 104 may be beveled at an angle. In some cases, edge 104 may be beveled at an angle sloping downward from the plane of the ground-engaging portion of first end 101. In other cases, edge 104 may be beveled at an angle sloping upward from the plane of the ground-engaging portion of first end 101. In the exemplary embodiment shown in FIGS. 1 through 3, edge 104 is beveled at an angle sloping downward from the plane of the ground-engaging portion of first end 101. In different embodiments, edge 104 may be various types, including, but not limited to: chisel-point, tapered, faceted, convex, concave, as well as other straight or curved designs. In some embodiments, edge 104 may be configured at an angle determined to accelerate penetration with a particular type of playing surface. In other embodiments, edge 104 may be configured at an angle determined to increase friction with a particular type of playing surface.

As shown in FIG. 1, a grounding-engaging portion of first end 101 may include a curved portion 106. In this embodiment, curved portion 106 of first end 101 is a semi-circular shape. In different embodiments, curved portion 101 of first end 106 may be curved, semi-circular, ovoid, v-shaped, straight, as well as other geometric and regular and irregular shapes.

Referring to FIG. 1, in some embodiments, cleat 100 may include a rib structure 108. In this embodiment, rib structure 108 extends a distance along member 110 from first end 101. Rib structure 108 may provide strength and/or stiffness to member 110 of cleat 100. In some embodiments, rib structure 108 may extend a distance along a length of member 110 from first end 101 to provide support to the ground-engaging portion of first end 101. In one exemplary embodiment, rib structure 108 may extend along the entire length of member 110. In other embodiments, rib structure may extend a distance along a width of member 110. In some cases, rib structure 108 may extend outward in a vertical direction a height from the surface of member 110. In different embodiments, rib structure 108 may various distances along a length, width and/or height of member 110.

In some embodiments, member 110 may include a second end 112. In an exemplary embodiment as shown in FIG. 2, second end 112 curves in an opposite direction as the first end. In other embodiments, second end 112 may curve in the same direction as the first end. In some exemplary embodiments, second end 112 may include a ground-engaging portion comprising one or more of a projection, an edge, and a curved portion as discussed above with regard to first end 101.

In an exemplary embodiment, member 110 may be a lever arm that is individually articulated so that cleat 100 has independent freedom of motion from any other cleat disposed on article of footwear 400. In other embodiments, one or more cleats may be disposed on member 110. In some cases, each cleat of a plurality of cleats on a single member may be individually articulated so that each cleat may move independently of any other cleat. In other cases, one or more cleats on one or more members may be joined so that the cleats and/or members move together.

Referring again to FIG. 2, cleat 100 is shown in a side view. In this embodiment, projection 102 is shown with a dome shape extending outward from first end 101 of member 110 and edge 104 is shown beveled at an angle sloping downward from the plane of the ground-engaging portion of first end 101. In the exemplary embodiment of FIG. 2, rib structure 108 is shown a height above the surface of member 110 and terminating a distance past the curve of first end 101. In some embodiments, rib structure 108 may extend outward in a vertical direction a certain height from the surface of member 110 to provide additional traction with a playing surface.

Referring to FIG. 3, a close up is shown of the ground-engaging portion of first end 101. In some embodiments, edge 104 may be beveled along curved portion 106 of first end 101. In some embodiments, rib structure 108 may be integrally formed with projection 102 so that rib structure 108 terminates in projection 102 at first end 101. In other embodiments, rib structure 108 and projection 102 may be separate. In different embodiments, various combinations of sizes and shapes of projection 102, edge 104, curved portion 106 and/or rib structure 108 may used to vary any of the traction, stability, and/or mobility properties of cleat 100 when used with an article of footwear on a particular type of playing surface.

In different embodiments, cleat 100 can be made of different materials. Examples of different materials that could be used include, but are not limited to: metallic materials, polymer materials including plastics and/or rubbers, composite materials, as well as any other kinds of materials. In some cases, the material used for cleat 100 can be selected according to the sport and/or playing surface with which cleat 100 is intended to be used. In other cases, the material used for cleat 100 can be selected according to the desired properties of cleat 100, including, but not limited to: durability, flexibility, ground penetration, friction, and grip. For example, in embodiments where cleat 100 is intended to be used with an article of footwear on a hard, natural playing surface, such as dirt, a metallic material such as aluminum, steel, iron or any other kind of metallic material could be used. In other cases, however, a rubber material may be used since rubber is more flexible. In other cases, however, cleat 100 could be made of any other kind of material.

Figure 4:
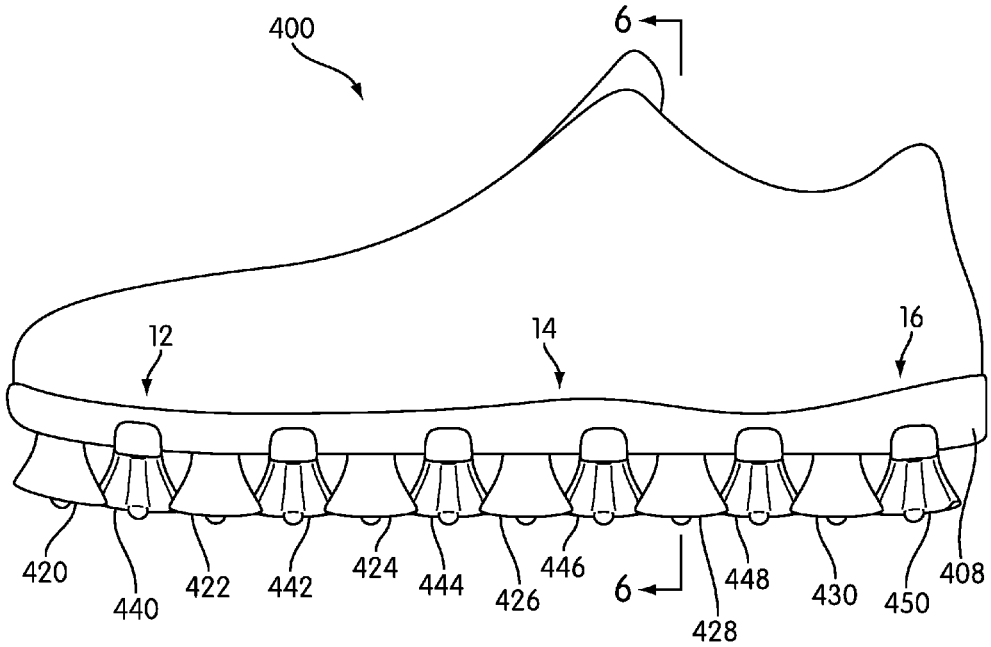
FIG. 4 is an isometric side view of an exemplary embodiment of an article of footwear with a plurality of cleats.
Figure 5:
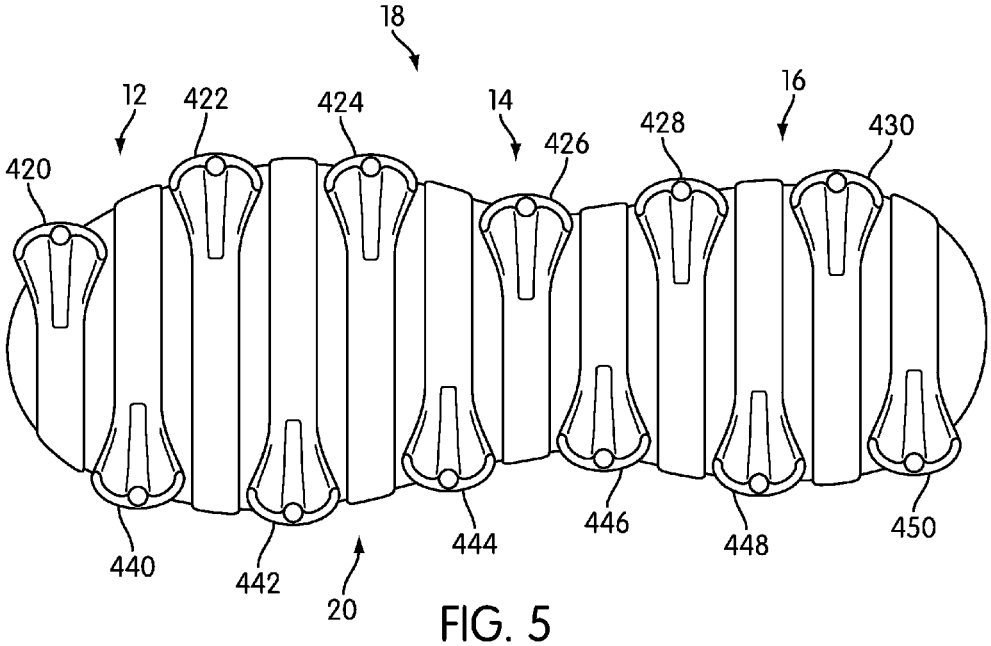
FIG. 5 is an isometric view of an exemplary embodiment of an outsole of an article of footwear with a plurality of cleats arranged in an exemplary configuration.

Referring now to FIGS. 4 and 5, for purposes of reference, article 400 may be divided into forefoot portion 12, midfoot portion 14, and heel portion 16. Forefoot portion 12 may be generally associated with the toes and joints connecting the metatarsals with the phalanges. Midfoot portion 14 may be generally associated with the arch of a foot. Likewise, heel portion 16 may be generally associated with the heel of a foot, including the calcaneus bone. In addition, article 400 may include lateral side 18 and medial side 20. In particular, lateral side 20 and medial side 18 may be opposing sides of article 400. Furthermore, both lateral side 18 and medial side 20 may extend through forefoot portion 12, midfoot portion 14, and heel portion 16.

It will be understood that forefoot portion 12, midfoot portion 14, and heel portion 16 are only intended for purposes of description and are not intended to demarcate precise regions of article 400. Likewise, lateral side 18 and medial side 20 are intended to represent generally two sides of an article, rather than precisely demarcating article 400 into two halves. In addition, forefoot portion 12, midfoot portion 14, and heel portion 16, as well as lateral side 18 and medial side 20, can also be applied to individual components of an article, such as a sole structure and/or an upper.

Article 400 can include a sole structure. In some embodiments, the sole structure may be configured to provide traction for article 400. In addition to providing traction, sole structure may attenuate ground reaction forces when compressed between the foot and the ground during walking, running or other ambulatory activities. The configuration of the sole structure may vary significantly in different embodiments to include a variety of conventional or non-conventional structures. In some cases, the configuration of the sole structure can be configured according to one or more types of ground surfaces on which the sole structure may be used. Examples of ground surfaces include, but are not limited to: natural turf, synthetic turf, dirt, as well as other surfaces.

The sole structure extends between the foot and the ground when article 400 is worn. In different embodiments, the sole structure may include different components. For example, as shown in FIG. 4, the sole structure may include an outsole 408, a midsole (not pictured), and/or an insole (not pictured). In some cases, one or more of these components may be optional.

Referring back to FIGS. 4 and 5, an exemplary embodiment of an article of footwear 400 is shown with a centipede cleat assembly comprising a plurality of cleats disposed on outsole 408 of article 400. In this embodiment, each of first cleat 420, second cleat 422, third cleat 424, fourth cleat 426, fifth cleat 428, sixth cleat 430 may be disposed on a lateral side 18 of article of footwear 400. Similarly, in this embodiment each of seventh cleat 440, eighth cleat 442, ninth cleat 444, tenth cleat 446, eleventh cleat 448, and twelfth cleat 450 may be disposed on a medial side 20 of article of footwear 400. Each of the plurality of cleats may be configured as discussed above with regard to cleat 100.

In some embodiments, each of the plurality of cleats may be attached to the sole structure of article of footwear 400. In some cases, each of the plurality of cleats may be attached to outsole 408. In other cases, each of the plurality of cleats may be integrally formed with outsole 408. In different embodiments, each of the plurality of cleats may be fixedly or removably attached to any portion of the sole structure.

Referring now to FIG. 5, an underside of article of footwear 400 is shown with the centipede cleat assembly comprising first cleat 420, second cleat 422, third cleat 424, fourth cleat 426, fifth cleat 428, sixth cleat 430, seventh cleat 440, eighth cleat 442, ninth cleat 444, tenth cleat 446, eleventh cleat 448, and twelfth cleat 450. In this embodiment, first cleat 420, second cleat 422, third cleat 424, fourth cleat 426, fifth cleat 428, sixth cleat 430, seventh cleat 440, eighth cleat 442, ninth cleat 444, tenth cleat 446, eleventh cleat 448, and twelfth cleat 450 are arranged in an alternating pattern to form the centipede cleat assembly. In this exemplary embodiment, the centipede cleat assembly refers to the arrangement of the plurality of cleats disposed on outsole 408 of article of footwear 400.

In the exemplary embodiment shown in FIG. 5, starting at forefoot portion 12 and extending along outsole 408 in the direction of heel portion 16, the centipede cleat assembly may be arranged as follows: first cleat 420 is disposed on lateral side 18, next seventh cleat 440 is disposed on medial side 20, then second cleat 422 is disposed on lateral side 18, and eighth cleat 442 is disposed on medial side 20. In this exemplary embodiment, the plurality of cleats continue to alternate between lateral side 18 and medial side 20 continuing with third cleat 424, ninth cleat 444, fourth cleat 426, tenth cleat 446, fifth cleat 428, eleventh cleat 448, sixth cleat 430, and finally ending with twelfth cleat 450 at heel portion 16.

The order and arrangement of the plurality of cleats to form the centipede cleat assembly shown in FIG. 5 and described above is exemplary. In different embodiments, a plurality of cleats may be disposed on outsole 408 in various arrangements to form a centipede cleat assembly. In some cases, a centipede cleat assembly may be arranged from a plurality of cleats to vary any of the traction, stability, and/or mobility properties of article of footwear 400 on a particular type of playing surface. In other cases, the size, shape and properties of portions of each of the individual cleats in the centipede cleat assembly may vary as discussed above in regard to cleat 100.

Figure 6:
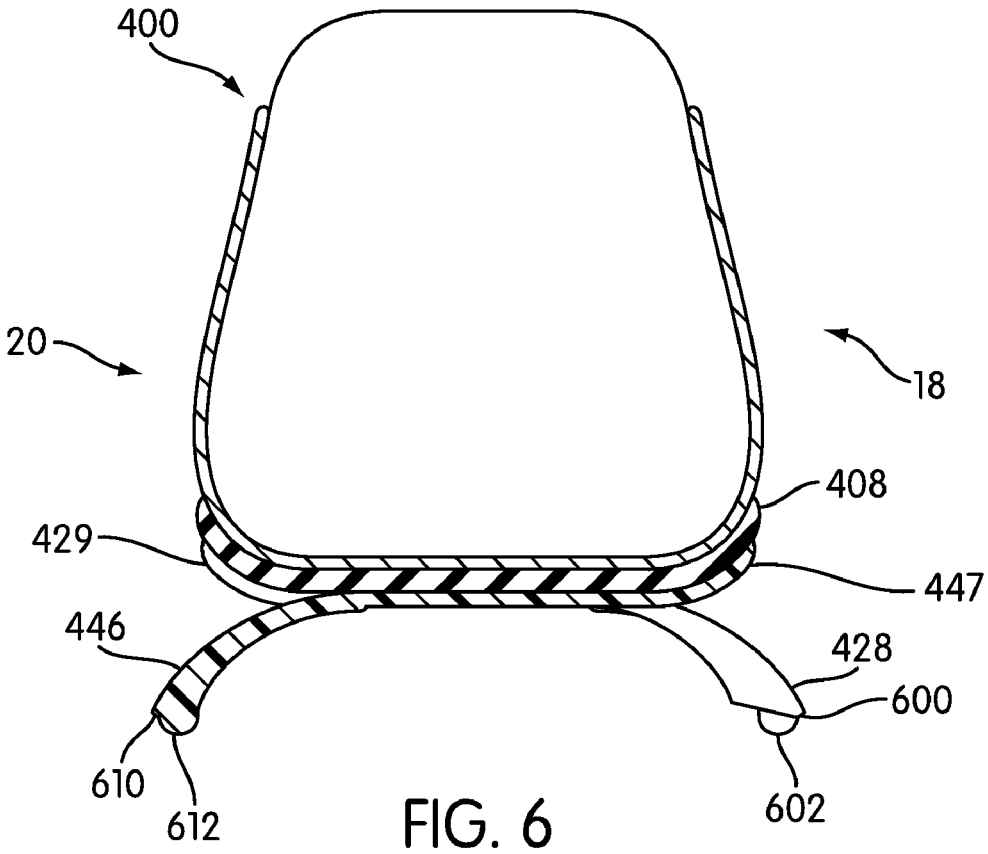
FIG. 6 is a cross section view of an exemplary embodiment of an article of footwear with a plurality of cleats with arm members.

FIG. 6 illustrates a cross-section view of an exemplary embodiment of article of footwear 400 with a plurality of cleats disposed on outsole 408 as shown in FIG. 4. Referring to FIG. 6, in this embodiment, article of footwear 400 is shown with fifth cleat 428 disposed on lateral side 20 and tenth cleat 446 disposed on medial side 18. In this embodiment, fifth cleat 428 includes a beveled edge 600, a dome-shaped projection 602, and an attachment end 429. Similarly, in this embodiment, tenth cleat 446 includes a beveled edge 610, a dome-shaped projection 612, and an attachment end 447. In some embodiments, each of the plurality of cleats may be attached to outsole 408 as discussed above. As shown in FIG. 6, fifth cleat 428 may be attached to outsole 408 at attachment end 429 and tenth cleat 446 may be attached to outsole 408 at attachment end 447. In this embodiment, attachment ends 429 and 447 curve upwards to conform to the shape of outsole 408. In some cases, the shape of attachment ends 429 and 447 may disperse forces associated with the interaction of fifth cleat 428 and tenth cleat 446 with a playing surface. In other cases, the shape of attachment ends 429 and 447 may contribute to stability of article of footwear 400. In other embodiments, the plurality of cleats may be attached to outsole 408 along a member, an attachment end, or both of each cleat.

Figure 7:
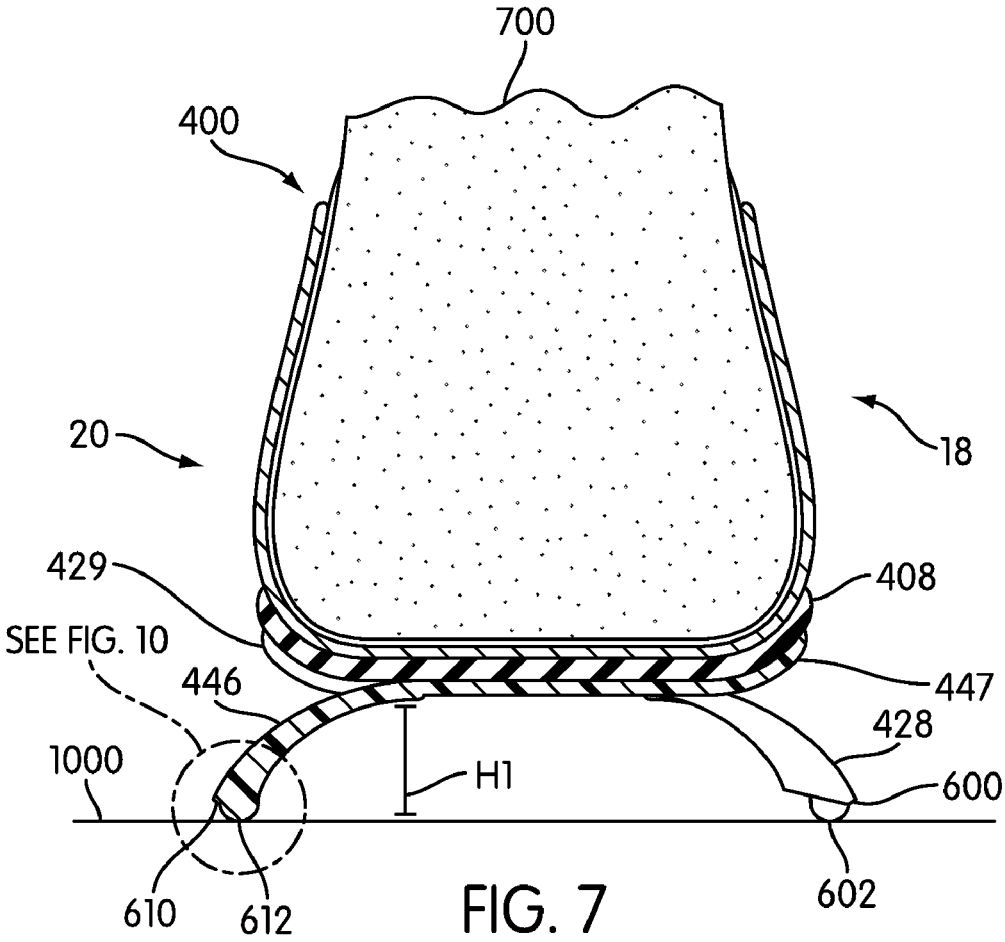
FIG. 7 is a cross section view of an exemplary embodiment of an article of footwear with a plurality of cleats with arm members containing a foot of a wearer.
Figure 8:
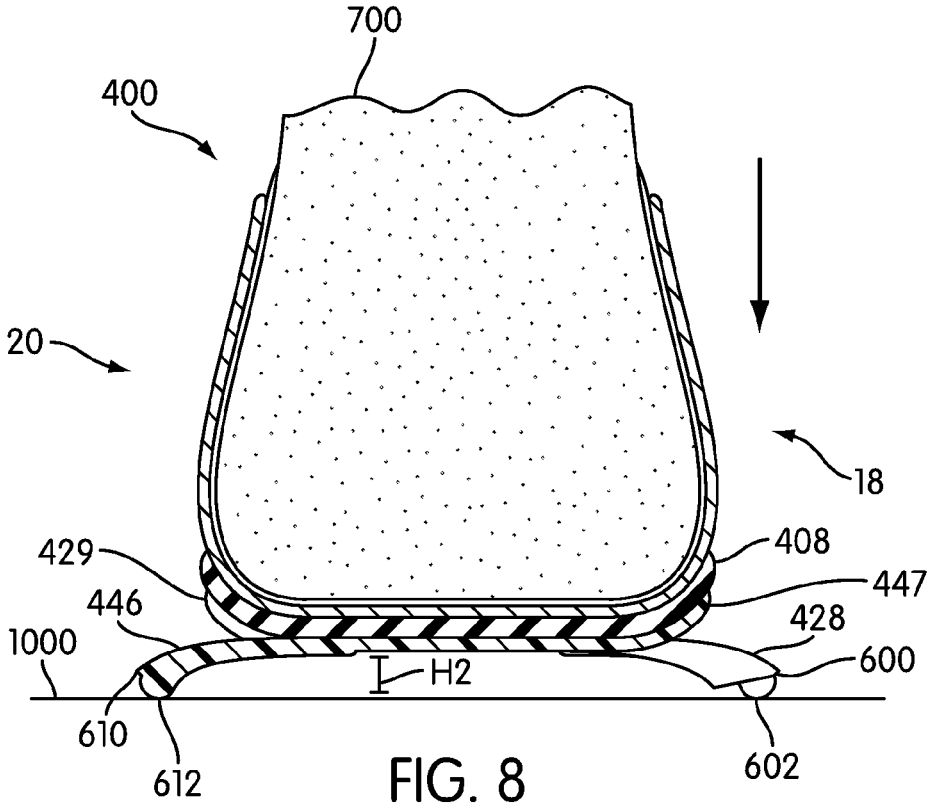
FIG. 8 is a cross section view of an exemplary embodiment of an article of footwear with a plurality of cleats with arm members containing a foot of a wearer applying a downward force.
Figure 9:
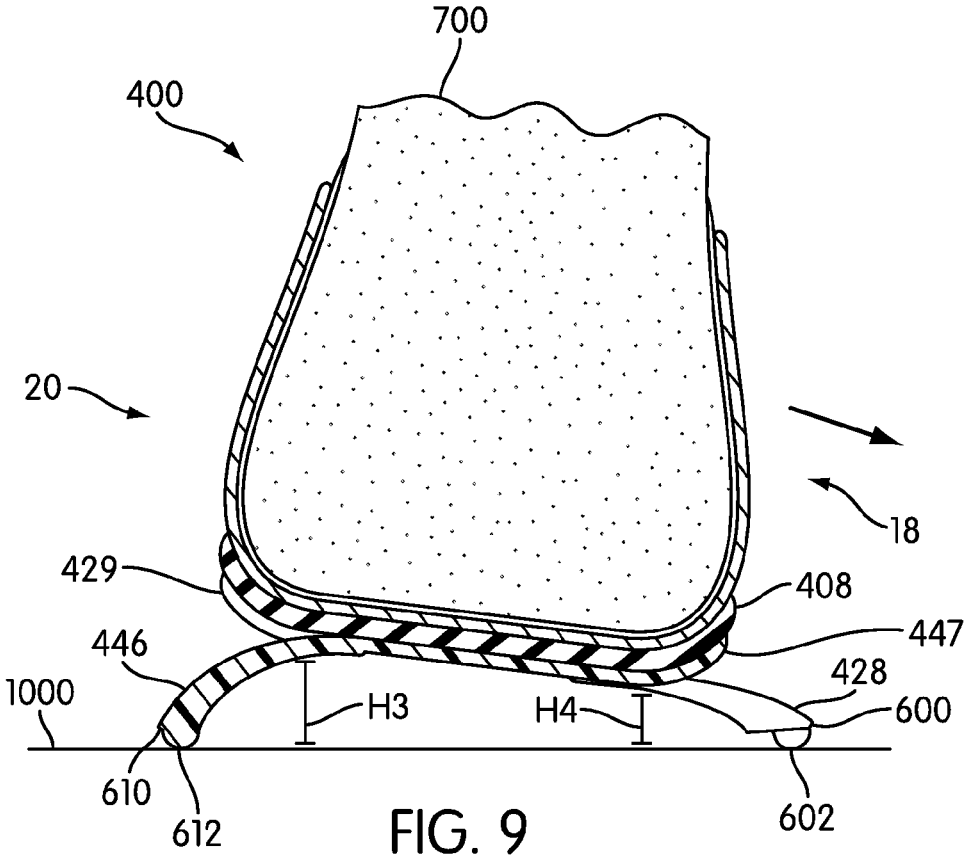
FIG. 9 is a cross section view of an exemplary embodiment of an article of footwear with a plurality of cleats with arm members containing a foot of a wearer applying a sideways force.

FIGS. 7 through 9 illustrate cross-section views of an exemplary embodiment of article of footwear 400 with a plurality of cleats disposed on outsole 408 as shown in FIG. 4 when worn by a wearer. Referring to FIG. 7, a foot 700 of a wearer is shown inside article of footwear 400. In this embodiment, projection 602 of fifth cleat 428 and projection 610 of tenth cleat 446 rest against a playing surface 1000. It should be understood that article of footwear 400 may include a plurality of cleats disposed on outsole 408. In some embodiments, the plurality of cleats, including fifth cleat 428 and tenth cleat 446, hold article of footwear 400 containing foot 700 at a height H1 above playing surface 1000. In different embodiments, the strength, flexibility, size, shape, curvature, and other properties of the plurality of cleats may be varied to hold article of footwear at a desired height above playing surface 1000.

FIG. 8 illustrates an exemplary embodiment of article of footwear 400 when a wearer exerts a downward force on playing surface 1000. As shown in this embodiment, when the wearer presses foot 700 downward on playing surface 1000, the plurality of cleats, including fifth cleat 428 and tenth cleat 446, may be articulated so that article of footwear 400 containing foot 700 moves from height H1 to height H2 above playing surface 1000. In different embodiments, the strength, flexibility, size, shape, curvature, and other properties of the plurality of cleats may be varied to provide different amounts of articulation to move article of footwear to a desired height above playing surface 1000 when pressed downward.

FIG. 9 illustrates an exemplary embodiment of article of footwear 400 when a wearer exerts a force with a lateral component on playing surface 1000. As shown in this embodiment, when the wearer presses foot 700 in a lateral direction on playing surface 1000, the plurality of cleats on lateral side 18, including fifth cleat 428, may be individually articulated from the plurality of cleats on medial side 20, including tenth cleat 446. With this configuration, when article of footwear 400 containing foot 700 moves in a lateral direction, the plurality of cleats on lateral side 18, including fifth cleat 428, move downward more than the plurality of cleats on medial side 20, including tenth cleat 446. As a result, fifth cleat 428 on lateral side 18 in the direction of force exerted by foot 700 is a height H4 above playing surface 1000, while tenth cleat 446 on medial side opposite the direction of force exerted by foot 700 is a height H3 above playing surface 1000. In this embodiment, height H4 is less than height H3.

In different embodiments, the strength, flexibility, size, shape, curvature, and other properties of the plurality of cleats on lateral side 18 and/or medial side 20 may be varied to provide different amounts of individual articulation to move article of footwear to various desired heights above playing surface 1000 when a force is exerted in a given direction. In some embodiments, one or more of the plurality of cleats disposed on lateral side 18 and/or medial side 20 may be articulated together. In other embodiments, one or more of the plurality of cleats disposed on lateral side 18 and/or medial side 20 may be fixed and not capable of articulation.

It should be understood that while in the exemplary embodiment shown in FIG. 9 a force is exerted with a component in a lateral direction, the features described above apply equally to a force with a component in different directions, including a medial direction, as well as combinations of forces in lateral, medial, and/or downward directions.

Figure 10:
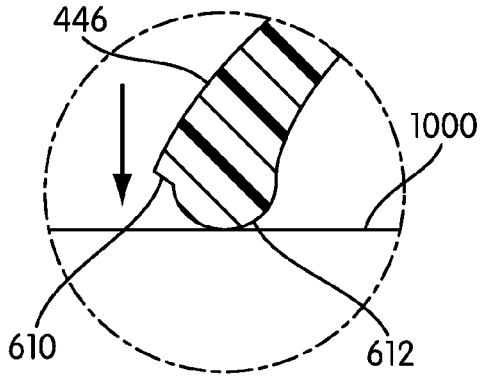
FIG. 10 is an enlarged view of an embodiment of a portion of a cleat applying a force to a ground surface.
Figure 11:
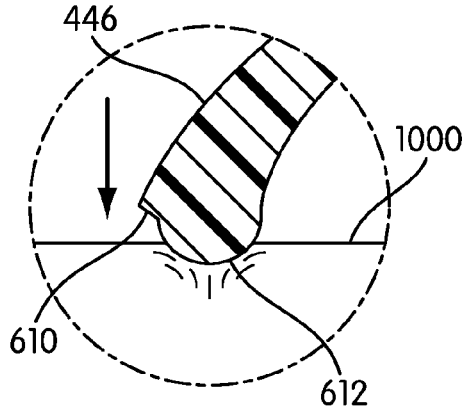
FIG. 11 is an enlarged view of an embodiment of a portion of a cleat penetrating a ground surface.
Figure 12:
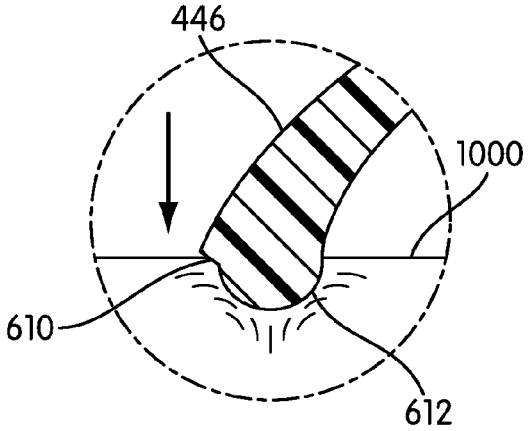
FIG. 12 is an enlarged view of an embodiment of a portion of a cleat penetrating a ground surface.

FIGS. 10 through 12 illustrate a series of close up views of an exemplary embodiment of tenth cleat 446 penetrating a playing surface 1000 when a wearer of article of footwear 400 exerts a downward force. Referring to FIG. 10, in this embodiment, tenth cleat 446 of article of footwear 400 containing foot 700 of a wearer as shown in FIG. 7 is shown resting against a playing surface 1000. In this embodiment, playing surface 1000 is grass or natural turf. In other embodiments, playing surface may include, but is not limited to: natural turf, synthetic turf, dirt, as well as other surfaces. In some embodiments, tenth cleat 446 may include projection 610 and edge 610. In this embodiment, projection 610 is a dome and edge 610 is beveled at an angle sloping away from the plane of the ground-engaging portion of tenth cleat 446.

FIG. 11 illustrates the penetration of a portion of tenth cleat 446 with playing surface 1000. In this embodiment, as a wearer exerts a downward force on article of footwear 400, a portion of tenth cleat 446 penetrates the top-most portion of playing surface 1000. As shown in FIG. 11, projection 612 may initially penetrate the top-most portion of playing surface 1000. In an exemplary embodiment, the dome shape of projection 612 may assist penetration with the top-most portion of playing surface 1000. In different embodiments, projection 612 may be various sizes and shapes to assist with penetration with the top-most portion of playing surface 1000. In some cases, different sizes and/or shapes of projection 612 may be selected for different playing surfaces.

Referring to FIG. 12, after initial penetration of the top-most portion of playing surface 1000 by projection 612, edge 610 may penetrate playing surface 1000. In this embodiment, a downward force may continue to be exerted by a wearer of article 400 after initial penetration of projection 612. The continued downward force may cause edge 610 of tenth cleat 446 to further penetrate playing surface. In some embodiments, edge 610 may be beveled at an angle to accelerate penetration with playing surface 1000. In this embodiment, edge 610 is beveled at an angle sloping away from the plane of the ground-engaging portion of tenth cleat 446. With this configuration, edge 610 may allow tenth cleat 446 to penetrate further into playing surface 1000. In different embodiments, edge 610 may be beveled at various angles to provide less or more penetration with playing surface 1000.

It should be understood that while in the exemplary embodiment shown in FIGS. 10 through 12 a force is shown exerted in a downward direction, the features described above apply equally to a force with a component in different directions, including a lateral direction, medial direction, and longitudinal direction, as well as combinations of forces different directions.

Figure 13:
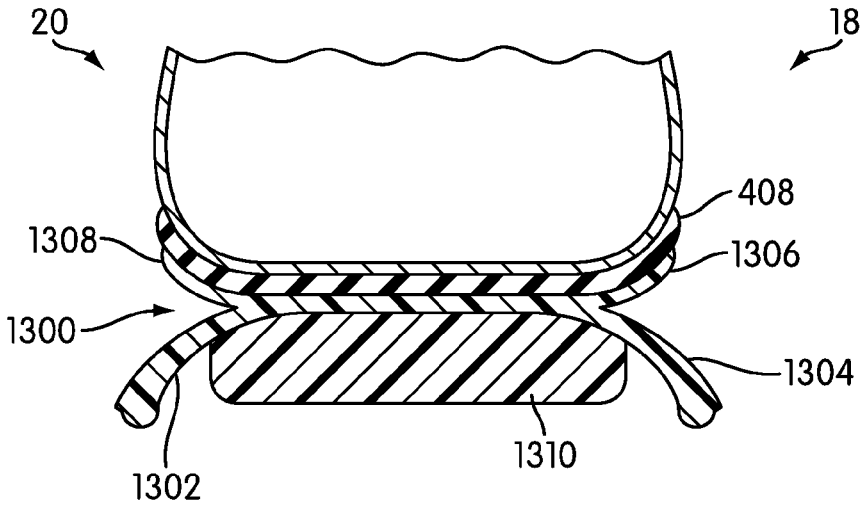
FIG. 13 is a cross section view of an exemplary embodiment of an article of footwear with a plurality of cleats with arm members.
Figure 14:
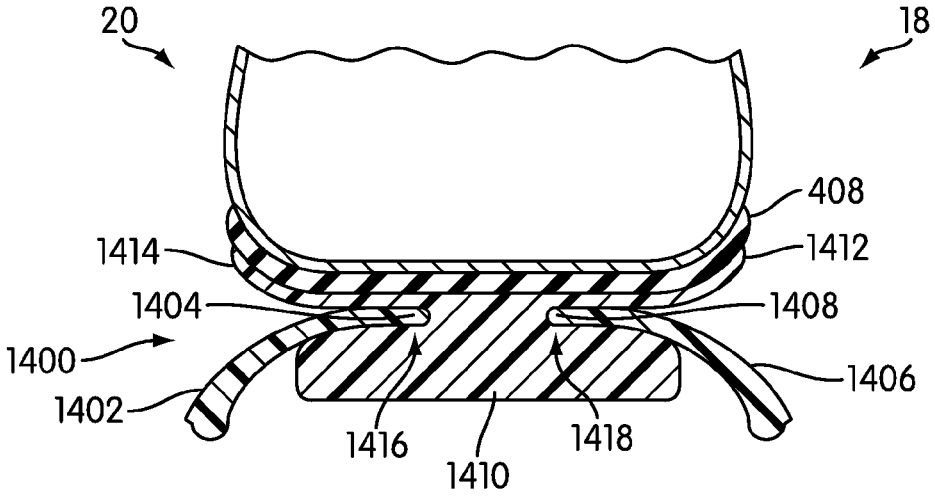
FIG. 14 is a cross section view of an exemplary embodiment of an article of footwear with a plurality of cleats with removable arm members.
Figure 15:
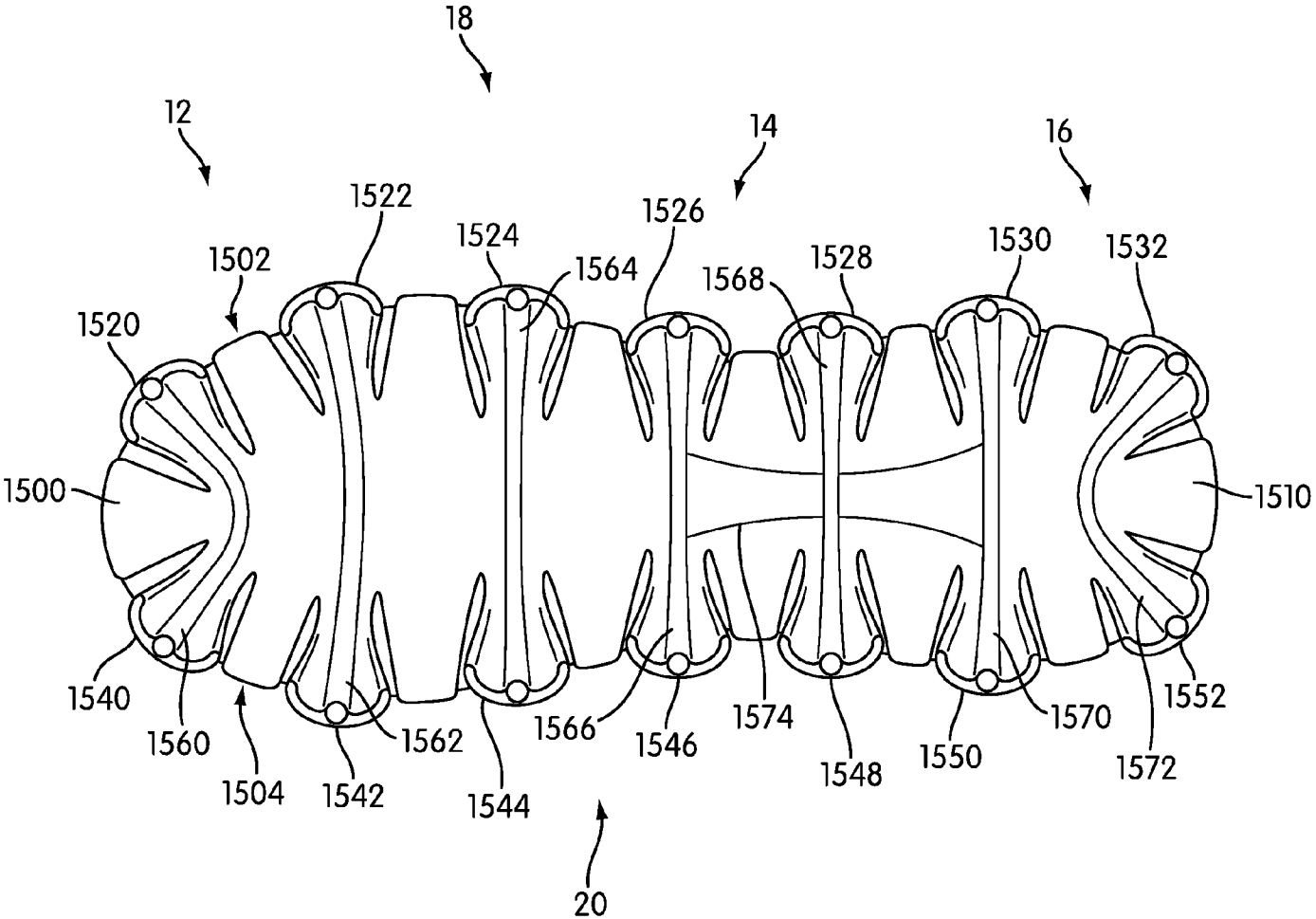
FIG. 15 is an isometric view of an exemplary embodiment of an outsole of an article of footwear with a plurality of cleats arranged in an exemplary configuration.

FIGS. 13 through 15 illustrate different exemplary embodiments of centipede cleat assemblies that may include a plurality of cleats disposed on a sole structure of an article of footwear in different configurations.

In different embodiments, centipede cleat assemblies can be made of different materials. Examples of different materials that could be used include, but are not limited to: metallic materials, polymer materials including plastics and/or rubbers, composite materials, as well as any other kinds of materials. In some cases, the material used for the centipede cleat assembly can be selected according to the sport and/or playing surface with which the centipede cleat assembly is intended to be used. In other cases, the material used for the centipede cleat assembly can be selected according to the desired properties of the centipede cleat assembly, including, but not limited to: durability, flexibility, ground penetration, friction, and grip. For example, in embodiments where the centipede cleat assembly is intended to be used with an article of footwear on a hard, natural playing surface, such as dirt, a metallic material such as aluminum, steel, iron or any other kind of metallic material could be used. In other cases, however, a rubber material may be used since rubber is more flexible. In other cases, however, the centipede cleat assembly could be made of any other kind of material.

FIG. 13 illustrates a cross-section view of an article of footwear with an exemplary embodiment of a centipede cleat assembly. In this embodiment, a centipede cleat assembly 1300 may include a first cleat 1302 on medial side 20 and a second cleat 1304 on lateral side 18 of an article of footwear. As shown in FIG. 13, in some embodiments, centipede cleat assembly 1300 may be formed such that first cleat 1302 and second cleat 1304 are disposed at separate ends of a single member. In other embodiments, centipede cleat assembly 1300 may be formed from a plurality of cleats disposed at various locations over a single integral piece of material. In some cases, centipede cleat assembly 1300 may be formed as a plate including one or more individual cleats disposed over the surface of the plate. In other cases, centipede cleat assembly 1300 may be formed as a group of two or more individual cleats.

In some embodiments, one or more centipede cleat assemblies with various arrangements of cleats may be included on an article of footwear. In different embodiments, centipede cleat assembly 1300 may be removable or fixed to article of footwear. In other embodiments, centipede cleat assembly 1300 may be interchangeable with other centipede cleat assemblies with different configurations. In some cases, centipede cleat assembly 1300 may be provided with different configurations and/or types of cleats for different playing surfaces.

Referring back to FIG. 13, in this embodiment, centipede cleat assembly 1300 may attach to outsole 408 of article of footwear at a first attachment end 1306 and a second attachment end 1308. In this embodiment, first attachment end 1306 and second attachment end 1308 are shaped to conform to a shape of outsole 408 of the article of footwear. In different embodiments, centipede cleat assembly 1300 may be attached to the sole structure of article of footwear. In some embodiments, one or more portions of cleat assembly 1300 may be attached to outsole 408, including, but not limited to: along a bottom, side, or both. In other embodiments, each of a plurality of centipede cleat assemblies may be integrally formed with outsole 408. In different embodiments, centipede cleat assembly 1300 may be fixedly or removably attached to any portion of the sole structure.

As shown in FIG. 13, cleat assembly 1300 may include a structure 1310. In this embodiment, structure 1310 is disposed between first cleat 1302 and second cleat 1304. In some cases, structure 1310 may provide stability for the article of footwear. In other cases, structure 1310 may include a ground-engaging portion that may contact a playing surface. In some embodiments, structure 1310 may be a rib structure as discussed above. In different embodiments, structure 1310 may be various sizes, thicknesses, and/or heights. In some cases, the size, thickness, and/or height of structure 1310 may be selected to provide any one or more of stability, traction, support, and other properties to the article of footwear.

Referring now to FIG. 14, an exemplary embodiment of a centipede cleat assembly 1400 disposed on an article of footwear is illustrated in a cross-section view. In this embodiment, centipede cleat assembly 1400 may include a first cleat 1402 on medial side 20 and a second cleat 1406 on lateral side 18 of an article of footwear. As shown in FIG. 14, first cleat 1402 and second cleat 1406 may be attached to centipede cleat assembly 1400.

In some embodiments, first cleat 1402 and second cleat 1406 may be removably attached to cleat assembly 1400. In this embodiment, an engagement end 1404 of first cleat 1402 is configured to engage with a receiving portion 1416 of cleat assembly 1400. Similarly, an engagement end 1408 of second cleat 1406 may be configured to engage with a receiving portion 1418 of cleat assembly 1400. With this configuration, first cleat 1402 and second cleat 1406 may be replaced or changed by a wearer. In some embodiments, any one or more of a plurality of cleats disposed on centipede cleat assembly 1400, including first cleat 1402 and/or second cleat 1406, may be replaced or changed. In some cases, one or more cleats may be replaced due to wear or breakage. In other cases, one or more cleats may be changed to give desired properties to the article of footwear, including, but not limited to: traction, mobility, and stability. In other cases, one or more cleats may be changed based on a condition or type of playing surface.

Referring to FIG. 14, centipede cleat assembly 1400 may attach to outsole 408 of article of footwear at a first attachment end 1412 and a second attachment end 1414. In this embodiment, first attachment end 1412 and second attachment end 1414 are shaped to conform to a shape of outsole 408 of the article of footwear. In different embodiments, centipede cleat assembly 1400 may be attached to the sole structure of article of footwear. In some embodiments, one or more portions of cleat assembly 1400 may be attached to outsole 408, including, but not limited to: along a bottom, side, or both. In other embodiments, each of a plurality of centipede cleat assemblies may be integrally formed with outsole 408. In different embodiments, centipede cleat assembly 1400 may be fixedly or removably attached to any portion of the sole structure.

As shown in FIG. 14, cleat assembly 1400 may include a structure 1410. In this embodiment, structure 1410 is disposed between first cleat 1402 and second cleat 1406. As shown in FIG. 14, structure 1410 may include a receiving portion 1416 for receiving attachment end 1404 of first cleat 1402 and a receiving portion 1418 for receiving attachment end 1408 of second cleat 1406. In some cases, structure 1410 may provide stability for the article of footwear. In other cases, structure 1410 may include a ground-engaging portion that may contact a playing surface. In some embodiments, structure 1410 may be a rib structure as discussed above. In different embodiments, structure 1410 may be various sizes, thicknesses, and/or heights. In some cases, the size, thickness, and/or height of structure 1410 may be selected to provide any one or more of stability, traction, support, and other properties to the article of footwear.

FIG. 15 illustrates an underside of an exemplary embodiment of a centipede cleat assembly disposed on an article of footwear. In this exemplary embodiment, the centipede cleat assembly refers to the arrangement of the plurality of cleats disposed on an outsole of an article of footwear. In this embodiment, beginning at forefront portion 12 on lateral side 18, the centipede cleat assembly comprises a first forefront cleat 1520, a first lateral cleat 1522, a second lateral cleat 1524, a third lateral cleat 1526, a fourth lateral cleat 1528, a fifth lateral cleat 1530, and a first heel cleat 1532. Similarly, beginning at forefront portion 12 on medial side 20, the centipede cleat assembly comprises a second forefront cleat 1540, a first medial cleat 1542, a second medial cleat 1544, a third medial cleat 1546, a fourth medial cleat 1548, a fifth medial cleat 1550, and a second heel cleat 1552. It should be understood that the order and arrangement of the cleats comprising the centipede cleat assembly described above is exemplary and other configurations and designs including the features discussed herein are contemplated.

In some embodiments, the centipede cleat assembly may be arranged as a plate containing a plurality of cleats. In some embodiments, the centipede cleat assembly may include tab portions that may be disposed between one or more of the plurality of cleats. In some cases, the tab portions may be attached to a sole structure of an article of footwear. In other cases, the tab portions may provide stiffness, support, and/or flexibility to the article of footwear.

As shown in FIG. 15, the centipede cleat assembly includes a forefront tab 1500 disposed between first forefoot cleat 1520 and second forefoot cleat 1540. In this embodiment, the centipede cleat assembly also may include a heel tab 1510 disposed between first heel cleat 1532 and second heel cleat 1552. The centipede cleat assembly may also include a lateral tab 1502 disposed between first forefoot cleat 1520 and first lateral cleat 1522 and a medial tab 1504 disposed between second forefoot cleat 1540 and first medial cleat 1542. In a similar manner, the centipede cleat assembly may include one or more tab portions between any of the plurality of cleats disposed on the article of footwear.

Referring again to FIG. 15, in some embodiments, the centipede cleat assembly may include one or more structures disposed between cleats. In this embodiment, the centipede cleat assembly includes a forefoot structure 1560 disposed along the length of first forefoot cleat 1520 and second forefoot cleat and a heel structure 1572 disposed along the length of first heel cleat 1532 and second heel cleat 1552. In some embodiments, the centipede cleat assembly may include a first structure 1562 disposed along the length of first lateral cleat 1522 and first medial cleat 1542, a second structure 1564 disposed along the length of second lateral cleat 1524 and second medial cleat 1544, a third structure 1566 disposed along the length of third lateral cleat 1526 and third medial cleat 1546, a fourth structure 1568 disposed along the length of fourth lateral cleat 1528 and fourth medial cleat 1548, and a fifth structure 1570 disposed along the length of fifth lateral cleat 1530 and fifth medial cleat 1550.

In some embodiments, one or more of forefoot structure 1560, first structure 1562, second structure 1564, third structure 1566, fourth structure 1568, fifth structure 1570, and heel structure 1572 may comprise a rib structure as discussed above. In this exemplary embodiment, each of the plurality of structures is shown extending from a projection of a cleat on one side of the article of footwear along the length of the cleat to the projection on the cleat located on the opposite side. In different embodiments, each of the plurality of structures may extend various lengths along one or more cleats. In some cases, the structure may not connect cleats on opposite sides of an article of footwear.

In some embodiments, each of the plurality of structures on the centipede cleat assembly may extend outward in a vertical direction a certain height from the surface. In some cases, the structure may be used to provide additional traction with a playing surface. In other cases, the structure may be used to provide stability or support to an article of footwear. In different embodiments, each of the plurality of structures disposed on a centipede cleat assembly may be various lengths, heights, and/or widths to provide a desired property, including, but not limited to: traction, mobility, and stability.

In some embodiments, a centipede cleat assembly may include a support 1574. As shown in FIG. 15, support 1574 may be disposed on centipede cleat assembly between third structure 1566, fourth structure 1568, and fifth structure 1570. In some cases, support 1574 may be used to provide stability or support to an article of footwear. In other cases, support 1574 may be used to provide additional traction with a playing surface. Support 1574 may be various lengths, heights, and/or widths to provide a desired property, including, but not limited to: traction, mobility, and stability. In this embodiment, support 1574 is shown disposed in a longitudinal direction along midfoot portion 14 of the article of footwear. In different embodiments, support 1574 may be provided along various portions of the article of footwear, including forefoot portion 12, midfoot portion 14, and heel portion 16, as well as provided in any lateral and/or longitudinal direction. In other embodiments, support 1574 may be disposed between any one or more of the plurality of structures disposed on the centipede cleat assembly.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. A cleat for an article of footwear comprising:

a first member including a lever arm terminating in a first end and a second end;

the first end further including a first projection and a first curved portion; and a rib structure disposed a distance along the lever arm;

wherein the first curved portion includes a first beveled edge;

wherein the first projection extends a first distance from the curved portion; and wherein the rib structure is integrally formed and continuous with the first projection so that the rib structure terminates in the first projection at the first end of the lever arm.

2. The cleat according to claim 1, wherein the curved portion defines a substantially planar surface.

3. The cleat according to claim 1, wherein the first curved portion is semi-circular.

4. The cleat according to claim 1, wherein the first projection is a dome.

5. The cleat according to claim 2, wherein at least a portion of the first projection extends from the substantially planar surface of the curved portion.

6. An article of footwear, comprising the cleat according to claim 1, wherein the second end is attached to a sole structure of the article of footwear.

7. The cleat according to claim 1, wherein the second end comprises:

a second projection;

a second curved portion; and wherein the second curved portion includes a second beveled edge.

8. An article of footwear including a cleat, the cleat comprising:

a first lever arm;

a first ground-engaging portion disposed at a first end of the first lever arm;

a second end of the first lever arm attached to a sole structure of the article of footwear; and wherein the second end of the first lever arm curves upwards to conform to a shape of an outsole of the article of footwear.

9. The article of footwear according to claim 8, wherein the first lever arm further includes a rib structure disposed a distance along the first lever arm.

10. The article of footwear according to claim 8, wherein the first ground engaging portion comprises:

a projection;

a curved portion; and wherein the first curved portion includes a beveled edge.

11. The article of footwear according to claim 10, wherein the curved portion is semi-circular.

12. The article of footwear according to claim 10, wherein the projection is a dome.

13. The article of footwear according to claim 8, further comprising:

a second lever arm including a second ground engaging portion disposed at a first end of the second lever arm; and wherein a second end of the second lever arm is attached to the sole structure of the article of footwear to allow individual articulation of the second lever arm.

14. The article of footwear according to claim 13, wherein the second end of the first lever arm is attached to the second end of the second lever arm;

the cleat further comprises:

a rib structure disposed a distance along the first lever arm and the second lever arm.

15. An article of footwear, comprising:

an upper;

a sole structure attached to the upper;

a plurality of cleats attached to the sole structure, wherein each of the plurality of cleats comprises:

a lever arm; and a ground-engaging portion disposed at a first end of the lever arm;

the ground-engaging portion further including a projection and a curved portion;

wherein the curved portion includes a beveled edge; and wherein the curved portion defines a substantially planar surface.

16. The article of footwear according to claim 15, wherein each of the plurality of cleats are attached to the sole structure at a second end of the lever arm to allow individual articulation of the lever arm.

17. The article of footwear according to claim 15, wherein the lever arm further includes a rib structure disposed a distance along the lever arm.

18. The article of footwear according to claim 15, wherein the projection extends outward a distance from the beveled edge.

19. The article of footwear according to claim 15, wherein the curved portion is semi-circular.

20. The article of footwear according to claim 15, wherein the projection is a dome.

21. The article of footwear according to claim 15, wherein, when a first amount of downward force is applied by a wearer of the article of footwear, the plurality of cleats hold the article of footwear at a first height above a playing surface.

22. The article of footwear according to claim 21, wherein, when a second amount of downward force is applied by a wearer of the article of footwear, the plurality of cleats articulate hold the article of footwear at a second height above the playing surface.

23. The article of footwear of claim 15, wherein the first end of the lever arm includes a convex upper surface and a concave lower surface.

* * * * *